US010183394B1

(12) United States Patent
Dagnan, III et al.

(10) Patent No.: US 10,183,394 B1
(45) Date of Patent: Jan. 22, 2019

(54) TOOL-BIT HOLDER POUCH

(71) Applicants: Grady J. Dagnan, III, Agua Dulce, CA (US); Grady J. Dagnan, Jr., Agua Dulce, CA (US)

(72) Inventors: Grady J. Dagnan, III, Agua Dulce, CA (US); Grady J. Dagnan, Jr., Agua Dulce, CA (US)

( * ) Notice: Subject to any disclaimer, the term of this patent is extended or adjusted under 35 U.S.C. 154(b) by 431 days.

(21) Appl. No.: 14/881,039

(22) Filed: Oct. 12, 2015

Related U.S. Application Data

(60) Provisional application No. 62/063,115, filed on Oct. 13, 2014.

(51) Int. Cl.
*B25H 3/00* (2006.01)
*B65D 33/25* (2006.01)
*B65D 25/10* (2006.01)

(52) U.S. Cl.
CPC ..... *B25H 3/003* (2013.01); *B65D 25/10* (2013.01); *B65D 33/2508* (2013.01)

(58) Field of Classification Search
CPC ..... B25H 3/003; B25H 3/00; B65D 25/10; B65D 33/2508; B65D 2313/04; B23B 45/003
USPC ..... 206/818, 350; 224/671, 672, 675
See application file for complete search history.

(56) References Cited

U.S. PATENT DOCUMENTS 4,523,702 A * 6/1985 Viio ..... A45F 5/00 206/479
4,620,653 A * 11/1986 Farrell ..... A41F 9/002 224/219
4,928,823 A * 5/1990 Campbell ..... A45C 13/02 206/338
D314,699 S 2/1991 Tamosaitis et al.
5,056,661 A 10/1991 Balzano
5,586,706 A * 12/1996 Ritzenhein ..... A45F 3/00 224/194
5,810,525 A 9/1998 Ector
6,401,253 B2 6/2002 Brunson
6,494,323 B1 * 12/2002 Chalmers ..... A45C 11/00 206/350
6,571,997 B2 * 6/2003 Dedrick ..... A45F 5/00 224/183
6,675,965 B2 1/2004 Holland
(Continued)

FOREIGN PATENT DOCUMENTS

CN 2850379 Y 12/2006
WO WO2013026988 12/2013

*Primary Examiner* — Steven A. Reynolds
(74) *Attorney, Agent, or Firm* — Thomas I. Rozsa

(57) ABSTRACT

A tool-bit pouch having a front outer covering affixed to a front wall creating a closed magnet chamber between the front covering and the front wall, a magnet retained on a support member, the magnet and support member retained within the closed magnet chamber, a back including an outer back wall affixed to an interior back wall, an interior pouch chamber bounded by front wall, the rear interior wall, a bottom wall, a top wall, a right sidewall and a left sidewall, a strap retaining loop affixed to the outer back wall, a closing zipper extending from the left sidewall to top wall to the right sidewall to close the interior pouch chamber, the closing zipper moved by a zipper handle. A strap retaining loop on the exterior back wall to removably retain a retaining strap.

3 Claims, 13 Drawing Sheets

(56) References Cited

U.S. PATENT DOCUMENTS

| | | | | |
|---|---|---|---|---|
| 7,987,626 | B2 * | 8/2011 | Williams | F41A 29/02 206/223 |
| 8,066,268 | B2 * | 11/2011 | Brauer | B25F 5/029 269/130 |
| D684,764 | S | 6/2013 | Sigonin | |
| 2008/0185414 | A1 | 8/2008 | Conlon | |
| 2009/0314813 | A1 | 12/2009 | Woolery | |

* cited by examiner

TOOL-BIT HOLDER POUCH

CROSS-REFERENCE TO RELATED APPLICATION

This patent application claims priority to Provisional Application No. 62/063,115 filed on Oct. 13, 2014.

BACKGROUND OF THE INVENTION

1. Field of the Invention

This invention relates to the construction tool accessories industry, and more specifically to removable attachments such as a drill bit retained in a power tool or non-powered hand tool. The present invention relates to the field of professional and homeowner construction and removable accessories used with power and/or no power tools.

2. Description of the Prior Art

The following 11 patents and published patent applications are the closest prior art known to the inventor.

1. U.S. Design Pat. No. Des. 314,699 issued to Patricia L. Tamosaitis et al. on Feb. 19, 1991 for TOOL ACCESSORY HOLDER ATTACHMENT FOR A DRILL (hereafter the "Tamosaitis Design Patent");

2. U.S. Pat. No. 5,056,661 issued to Alfiero Balzano on Oct. 15, 1990 for TOOL CADDY (hereafter the "Balzano Patent");

3. U.S. Pat. No. 5,810,525 issued to Tommie L. Ector on Sep. 22, 1998 for TOOL AND BIT BAND FOR DRILLS (hereafter the "Ector Patent");

4. U.S. Pat. No. 6,401,253 issued to Mark E. Brunson on Jun. 11, 2002 for WORKER'S AID SYSTEM AND MODIFIED GLOVE (hereafter the "Brunson Patent");

5. U.S. Pat. No. 6,494,323 issued to Brenda J. Chalmers on Dec. 17, 2002 for CARRYING CASE ASSEMBLY FOR MAGNET-ATTRACTING OBJECTS (hereafter the "Chalmers Patent");

6. U.S. Pat. No. 6,675,965 issued to Matthew J. Holland et al. on Jan. 13, 2004 for TOOL POUCH WITH MAGNET IN THE POUCH (hereafter the "Holland Patent");

7. United States Published Patent Application No. 2008/0185414 to Jonathan Eric Conlon on Aug. 7, 2008 for TOOL POUCH WITH MAGNETS (hereafter the "Conlon Published Patent Application");

8. United States Published Patent Application No. 2009/0314813 to Andre A. Woolery on Dec. 24, 2009 for MAGNETIC TOOL HOLSTER (hereafter the "Woolery Published Patent Application);

9. U.S. Design Pat. No. D684,764 issued to Roger N. Sigonin on Jun. 25, 2013 for DRILL BIT STORAGE FOR TOOL POUCH (hereafter the "Sigonin Design Patent");

10. Chinese Patent No. CN2850379Y issued to Kunlin Xiao on Dec. 27, 2006 for FULL-ENCLOSED MAGNETIC POCKET (hereafter the Xiao Chinese Patent");

11. PCT Application No. WO 2013/026988 to Fabien Escherich on Feb. 28, 2013 for MAGNETIC BIT HOLDER BRACELET DEVICE (hereafter the "Escherich PCT Application").

The Campbell Patent discloses a holder for staples, carpet tacks, nails, screws and other discrete magnetizable items. Specifically, the patent discloses:

> "A holder for a box of staples or loose carpet tacks, nails, screws and the like discrete magnetizable items is provided. A magnet is located on the underneath side of the top closure member for the holder to which a plurality of loose carpet tacks may become attached and which are separated from a supply thereof when the holder is shaken, making for easy, safe and injury free retrieval of carpet tracks from the holder by a carpet installer.

The Tamosaitis Patent discloses a holder for various items which can be retained within the various adjacent loop configurations.

The Balzano Patent discloses:

> "A tool caddy is disclosed herein for releasably retaining a plurality of hand tools and hand tool accessories, which includes a base having a plurality of resilient retainers mounted thereon adapted to snap-lock with tools or accessories. An attachment device is carried on the base for detachably mounting the caddy to the wrist, belt or tool so that the accessories are readily available to the user during a work procedure. The attachment device may take the form of a hook and pile fastener directly carried on the base or carried on the ends of a strap. A belt loop is also contemplated as an attachment device."

The Ector Patent discloses a tool band which is wrapped around an item such as a drill and the accessories are retained within the band. Specifically, the patent discloses:

> "A tool holding assembly for placement around a handle portion and/or a body portion of a portable hand drill. The assembly includes a first elastic sleeve and a second elastic sleeve which are adapted for placement over the handle portion of the drill. The second sleeve partially overlaps the first sleeve, thereby providing additional tension to retain drill bits and other tools against the handle portion of the drill. The assembly may also include a third elastic sleeve which is adapted for placement over the body portion of the drill, and which is particularly disposed for retaining an elongate shank of a drill bit or the like. Together the various sleeves allow drill accessories such as drill bits, drill gimlets, and related tools to be retained upon the drill by tension of the elastic sleeves against the drill. The elastic sleeves are formed of any resilient material, however, rubber is preferred."

The Brunson Patent discloses a worker's glove which the worker can use when performing a construction project. The worker's glove has built into it a container which is located at the back portion of the hand. The container has magnetic side walls extending above the mounting surface and having a permanent magnet secured to the container between the side walls. The magnet is operable to attract and secure fasteners within the container such that the side walls inhibit the inadvertent contact by the worker using the device while enabling ready access to the fasteners by the worker.

The Chalmers Patent discloses a carrying case for tools. Specifically, the patent discloses:

> "A magnet 17 is conventionally disposed between the pieces of semi-rigid material 13,14. The magnet 17 is a rectangular plate which is disposed in the first half portion 15 of the pieces of semi-rigid material 13,14 between the inner and outer pieces of semi-rigid material 13,14. The magnet 17 is adapted to hold magnet-attracting objects thereto upon the inner piece of the semi-rigid material 14. A pocket 18 is conventionally disposed upon one of the pieces of semi-rigid material 13,14. The pocket 18 is disposed upon the second half portion 16 of the pieces of semi-rigid material 13,14 and upon the inner piece of semi-rigid material 14. The pocket 18 including a piece of material having side and bottom edges which are conventionally attached and sewn to the inner piece of semi-rigid material 14."

The Holland Patent discloses a tool pouch with magnet in the pouch. Specifically, the patent discloses:

"A tool pouch having a pocket with an opening to receive certain items. The pocket includes a magnetic member near the top of the pocket for holding items received in the pocket. The magnetic member assists in arranging items in the pocket."

The Conlon Published Patent Application discloses the uses of magnets on one side of a pocket and magnets on the opposite side of the pocket which have opposite polarities to repel each other which therefore keeps the pocket in the tool pouch open.

The Woolery Published Patent Application discloses a magnetic tool holster. Specifically, the patent application discloses:

"A magnetic holder/holster device is disclosed. The device includes a holster body to hold a tool, one or more magnets coupled to the surface of the body for holding work items, a securing strap, and an apparatus to removably attach to a belt. The one or more magnets are distributed across the surface so as to allow metallic work items to be secured to substantially all points of the surface. In some embodiments, the magnets are permanently coupled to the surface of the device. In some embodiments, the magnets are removably attached to the surface. In operation, the magnetic tool holder/holster allows a worker wearing the holder/holster device to securely hold metallic work items readily accessible on the magnetic holder/holster body via the magnetic attraction of the magnets. The magnetic tool holder/holster has the advantage of preventing the spilling of metallic work items as wells as making them more convenient to use by ensuring secure and convenient placing capabilities."

The Sigouin Design Patent discloses the concept of a pouch with a multiplicity of slots on the outside which retain various objects such as tools and drill bits.

The Xiao Chinese Patent discloses a fully enclosed magnetic pocket comprised of a pocket body and a pocket cover where the edges on the pocket cover are connected with the pocket body and wherein the periphery of a pocket mouth, which is buckled with the pocket cover, is provided with magnetic strips which are attracted to each other. This simply is a closing mechanism for the pocket using magnets.

The Escherich PCT Application discloses a magnetic bit holder bracelet device. Specifically, the PCT Application discloses:

"The subject of the present invention is a magnetic bit-holder bracelet device intended to be worn by a user on his wrist and to hold screwdriver or similar bits (1). It comprises a bracelet (2') made of plastic, that can be attached or fixed to said wrist, incorporating, over all or part of its circumference, a row of pockets (3') and holder cavities (4') built into said bracelet (2'), each formed by one of said pockets (3') or attached to said bracelet (2'), each in one of said pockets (3') and able to house axially, and removably, one of said bits (1), the blind end of each holder cavity (4') comprising a magnet able to apply a magnetic force of attraction to the bit (1) concerned in order to retain and hold it in the relevant holding cavity (4')."

SUMMARY OF THE INVENTION

The present invention is an improvement over the prior art in that this current invention provides a practical convenient storage pouch for drill bits, accessories and screws needed to do the job-at-hand. During many types of construction projects, a person will utilize what are collectively known as hand tools. The hand tools can be powered or non-powered and include tools such as a hammer, a screwdriver and a drill. While some of these tools are used on their own, there are many that require additional components. For example, a drill requires a bit to be attached with the size of the bit determined by the size of the hole being drilled. Similarly, drill bits come in many sizes, but it is common for individuals, both professional construction workers and home hobbyists, to frequently use different tool bits. This requires the removal of one tool bit from the tool in use with the replacement of a second tool bit.

It is an object of the present invention to save time and energy and to make this transition from the first tool bit to the second tool bit easier by providing a number of different tool bits within reach.

One of the problems encountered when using tools is that the additional components, such as drill bits, are often small. This problem is significantly increased when additional construction pieces, such as nuts, bolts, or screws are needed in conjunction with drill bits. Then, numerous tool bits and construction pieces need to be within reach for efficiency in construction. A person sometimes wears a belt or a small container with pouches into which the components and pieces are placed. However, neither of these solutions, or any of the other prior art devices/methods. provides a truly effective solution to this tool bit and construction piece problem.

It is also an object of the present invention to provide a means of quickly and easily transporting and accessing additional tool components and/or construction pieces. It is an additional object of the present invention to provide a tool-bit holder pouch also called a tool bit pouch to transport and access the components and pieces at the time the tool is being used.

It is a further object of the present invention to provide access to the components and pieces that will not require manipulating an opening to get to the components and pieces. The optimal means would provide a covered, secure transportation and storage pouch, along with immediate access that does not require removing a selected component and pieces from a container in which the components are retained until there is a use for at least one component retrieved from the present invention tool-bit holder pouch or tool bit pouch.

It is a key object of the present invention to provide a durable apparatus to be used by a construction worker (professional or home repair person) which enables the construction worker to take all of the various tool accessories and/or construction pieces with the construction worker when he/she is on a second floor or higher floor during construction such as framing a building, where not having all of the tool accessories would require the worker to return to ground level to collect the accessories.

It is also a key object of the present invention to provide an apparatus which facilitates access to the components while the tool is being used.

It is a major object of the present invention to provide an apparatus which provides both a covered secure transportation and storage of the tool components and also facilitates immediate access to the components and which also does not require removing the components and tool pieces from within the container/apparatus.

It is another key object of the present invention to have an apparatus which provides access to the components and pieces that does not require manipulating an opening of a container to get to the components and pieces.

It is also a key object of the present invention to include a magnet retained on a magnet support member where both the magnet and its support member are retained in a closed section located between a front cover and a front wall of a tool bit holder pouch, wherein drill bits and other tool accessories are magnetically retained outside of the tool bit holder pouch against the front cover and also magnetically retained within the tool bit holder pouch. Accessories which cannot be magnetically retained are retained by tool bit holders within the tool bit holder pouch.

It is another key object of the present invention to have a hook and loop type strap that is used to hold the pouch to a drill or other tool. In addition, there is a hook and loop area on the backside of the pouch to enable the tool bit holder pouch to be mounted to other hook and loop surfaces.

While the invention has been described in detail and pictorially shown in the accompanying drawings, it is not to be limited to such details, since many changes and modification may be made to the invention without departing from the spirit and the scope of the invention.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF EMBODIMENTS OF THE PRESENT INVENTION

Figure 1:
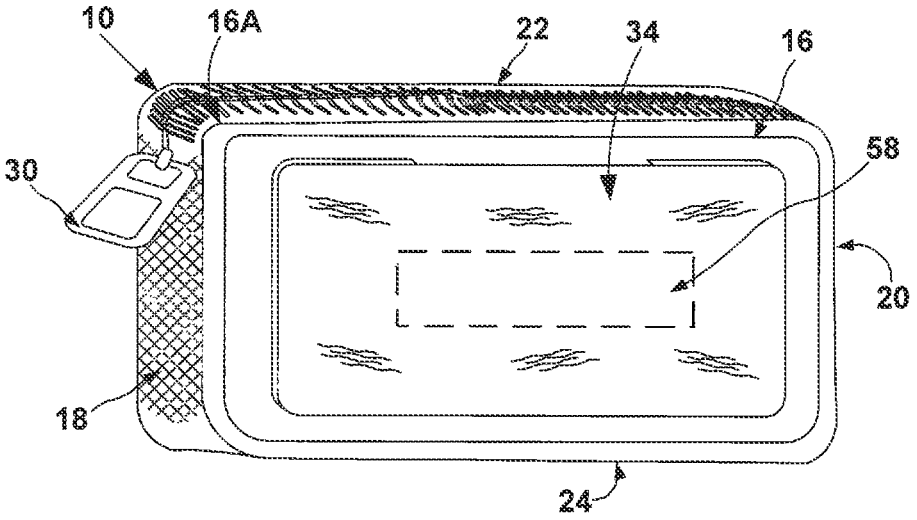
FIG. 1 is a rear perspective view of the present invention tool-bit holder pouch illustrating a single strap retaining loop.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The best mode for carrying out the invention is presented in terms that disclose a preferred embodiment of a tool bit pouch holder (sometimes defined in abbreviation as "TBPH") 10, which is also known as "The Bit-Pouch". During construction projects many small components are often used in combination with construction tools. The TBPH 10 provides a convenient means to temporarily store, permanently store, and retain for ready use small components used in the construction industry.

The TBPH 10 as shown in FIGS. 1 through 14 is comprised of a front outer covering 60 affixed to a front wall 14 with a chamber 62 between front covering 60 and front wall 14 with a magnet 48 retained on a support member 50 such as a plastic card, the magnet 48 and support member 50 retained in closed chamber 62. The TBPH 10 includes a back comprised of an outer back wall 16 affixed (such as by sewing) to an interior back wall 16A to provide greater strength to outer back wall 16. The TBPH 10 includes an interior pouch chamber 12 bounded by front wall 14, rear interior wall 16A, bottom wall 24, top wall 22, right sidewall 18 and left sidewall 20. A zipper 32 extends from left sidewall 20 to top wall 22 to right sidewall 18 to the interior 12 of the TBPH to close TBPH 10, the zipper 32 moved by a zipper handle 30. The enclosed magnet 48, enclosed drill bits and other tool accessories 2000A, 2000B, 2000C, 2000D and 2000E are retained against front covering 60 so that they can be easily grasped without having to open TBPH 10. The magnet 48 also enables additional drill bits, nails and other tool accessories to be retained against the interior of front wall 14 within chamber 12 of TBPH 10. If the accessories cannot be retained by a magnet, they are retained within enclosures of a tool bit holder 40 within chamber 12. A retaining member 26 having spaced apart hook and loop fasteners 38A, 38B, 38C and 38D which are affixed to member 26 by cross-stitching 36A, 36B, 36C and 36D provides a gap S70 between back outer wall 16 and strap loop 34 to enable a retaining strap 44 to be removably inserted through strap loop 34, the strap 44 having closure members to enable the strap 44 to be affixed around a tool 5000 such as a drill so that TBPH 10 is retained around a portion of tool 5000 to enable quick access to drill bits, nails and other construction accessories. A hook and loop member 80 is affixed to hook and loop retaining member 26 on a side facing away from back outer wall 16.

Variations such as more than one strap loop (34 and 34A), and different closure members such as hook and loop fasteners, snap fasteners etc. to enable the strap 44 to be affixed around a tool 5000 are within the spirit and scope of the present invention.

Figure 2:
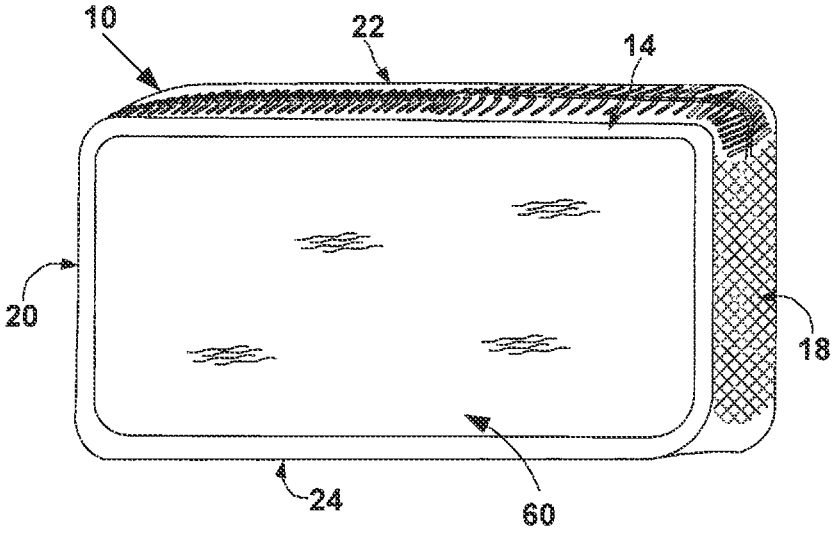
FIG. 2 is a front perspective view of the present invention tool-bit holder pouch.
Figure 3:
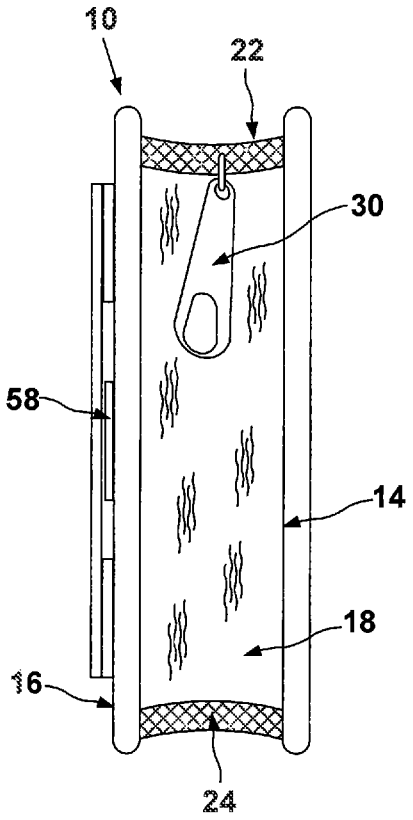
FIG. 3 is a right side view of the present invention tool-bit holder pouch in the closed condition.

The components of the TBPH 10 have been described above. The following figures provide a visual illustration of the TBPH 10. FIG. 1 is a rear perspective view of the present invention tool-bit holder pouch illustrating a single strap retaining loop 34. FIG. 2 is a front perspective view of the present invention TBPH 10 and FIG. 3 is a right side view of the present invention TBPH 10 in the closed condition. The TBPH 10 as shown in FIGS. 1 through 3 is comprised of a front outer covering 60 affixed to a front wall 14. The TBPH 10 includes a back comprised of an outer back wall 16 affixed to (such as by sewing) an interior back wall 16A to provide greater strength to outer back wall 16. The TBPH 10 further includes a bottom wall 24, a top wall 22, a right sidewall 18 and a left sidewall 20. A zipper 32 extends from left sidewall 20 to top wall 22 to right sidewall 18.

Figure 4:
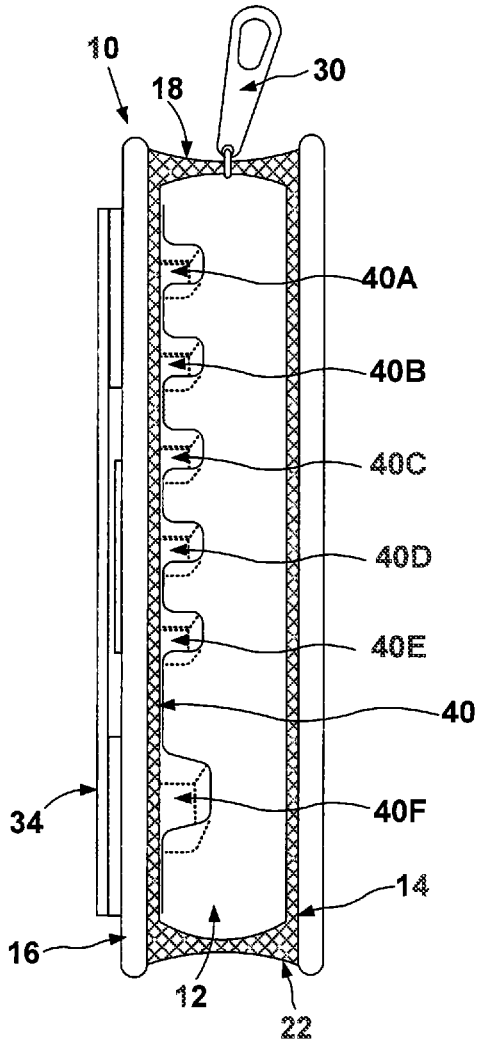
FIG. 4 is a top view of the present invention tool-bit holder pouch in the opened condition illustrating multiple tool bit holders within the tool-bit holder pouch.

FIG. 4 is a top view of the present invention TBPH 10 in the opened condition illustrating multiple tool bit holders 40A, 40B, 40C, 40D, 40E, 40F, 40G, 40H and 40I incorporated into the tool-bit holder member 40, which is within an interior pouch chamber 12. bounded by front wall 14, rear interior wall 16A, bottom wall 24, top wall 22, right sidewall 18 and left sidewall 20. Further referring to FIG. 4, the inner pouch pocket 12 is preferably dimensioned to allow a quantity of tool components and/or construction pieces to be retained therein.

Figure 7:
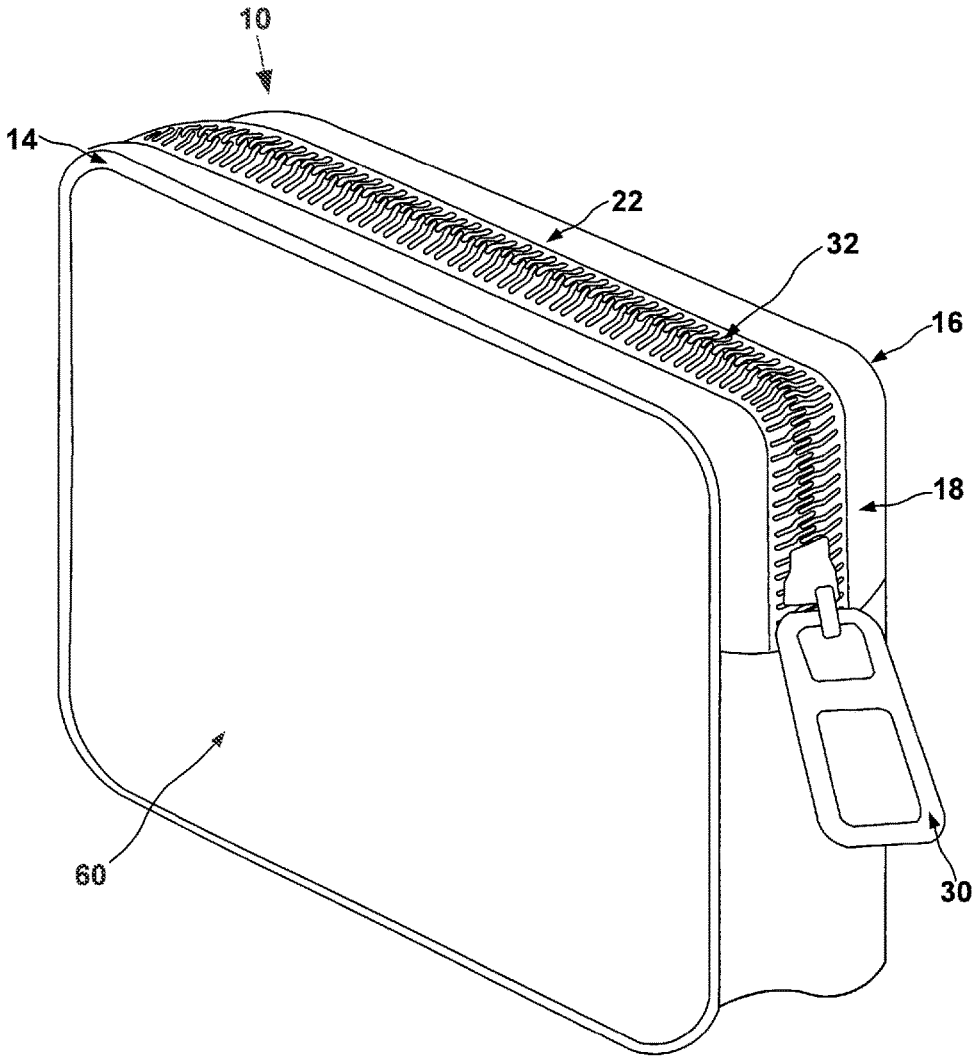
FIG. 7 is a top/front perspective view of the present invention tool-bit holder pouch.
Figure 8:
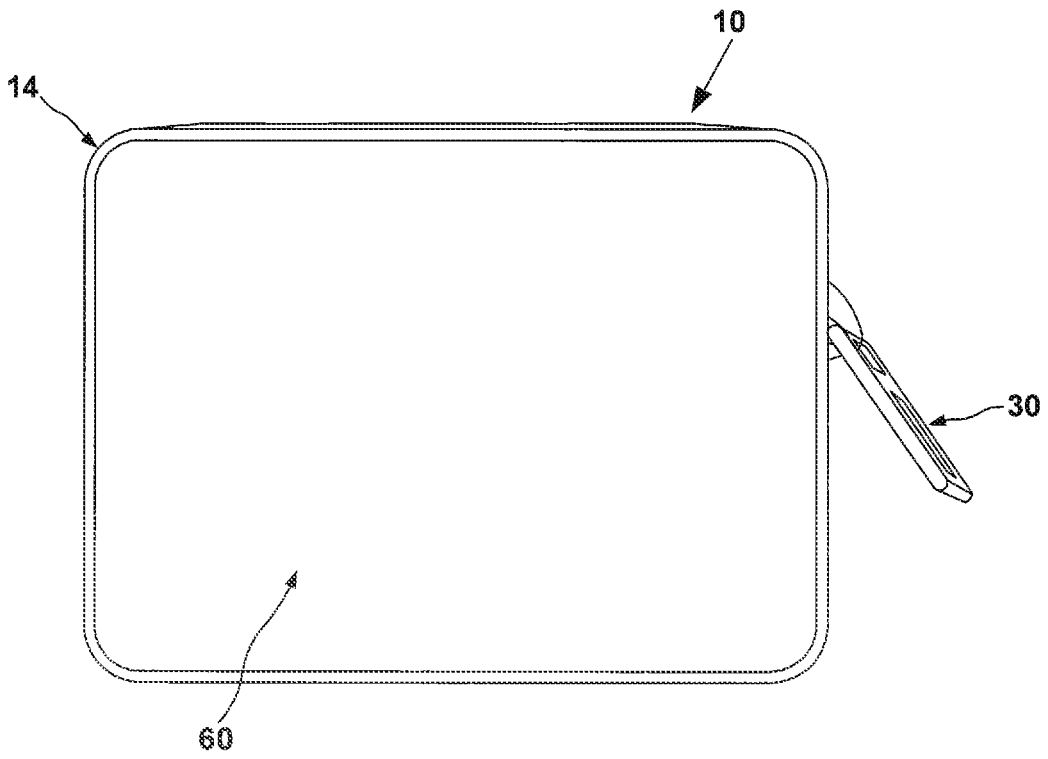
FIG. 8 is a front elevational view of the present invention tool-bit holder pouch.

FIG. 7 is a top/front perspective view of the present invention TBPH 10 and FIG. 8 is a front elevational view of the present invention TBPH 10. These Figures illustrate a front outer covering 60 affixed to a front wall 14 and a zipper 32 extending from left sidewall 20 to top wall 22 to right sidewall 18, the zipper 32 moved by a zipper handle 30.

Figure 9:
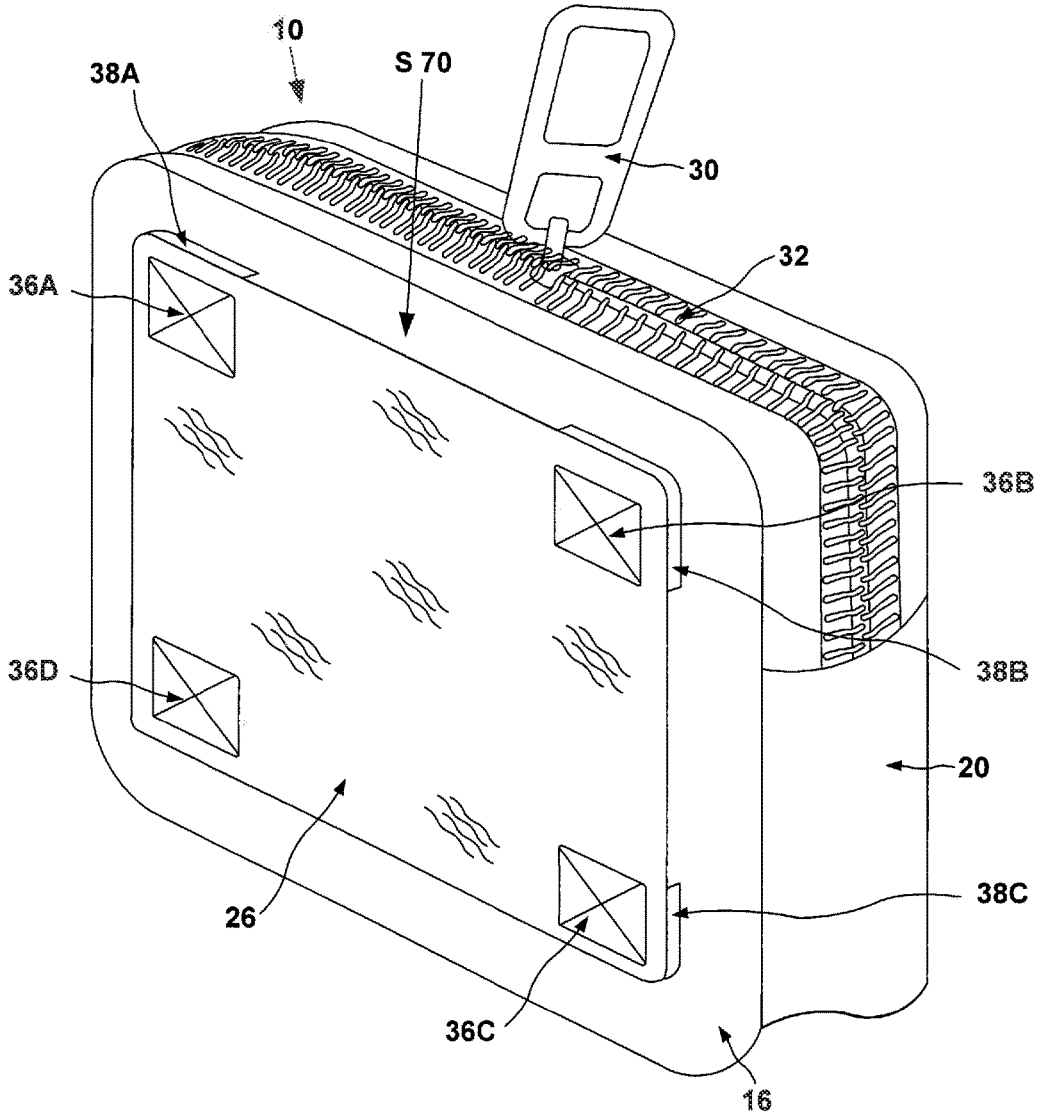
FIG. 9 is a top-rear perspective view of the present invention tool-bit holder pouch illustrating cross-stitching retaining hook and loop fasteners.
Figure 10:
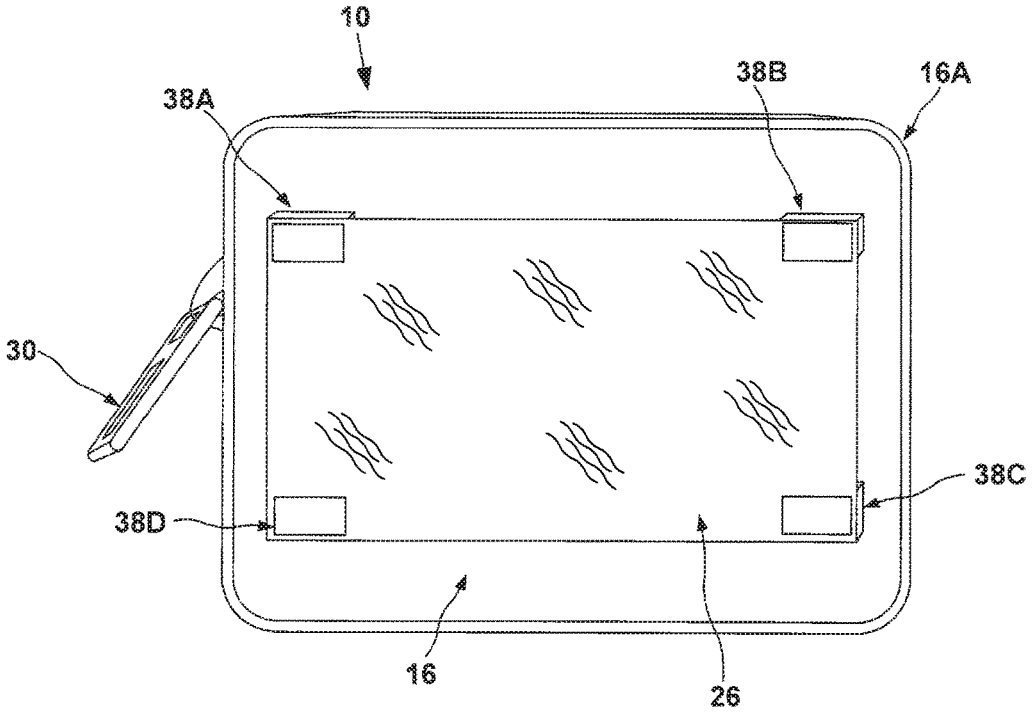
FIG. 10 is a rear elevational view of the present invention tool-bit holder pouch illustrating hook and loop fasteners.

FIG. 9 is a top-rear perspective view of the present invention TBPH 10 illustrating cross-stitching 36A, 36B, 36C and 36D retaining hook and loop fasteners 38A, 38B, 38C and 38D on a hook and loop retaining member 26 better illustrated in the rear elevational view of FIG. 10. The hook and loop spacers 38A, 38B, 389C and 38D create a gap S70 between hook and loop retaining member 26 and back outer wall 16.

Figure 11:
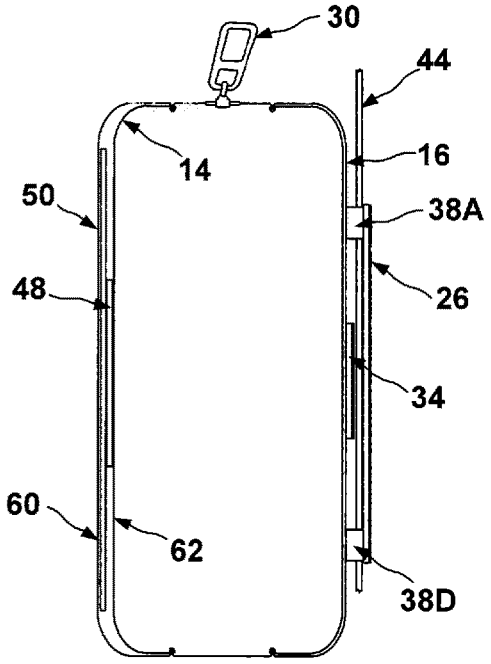
FIG. 11 is a side cross-sectional view of the present invention tool-bit holder pouch retained by a strap.
Figure 12:
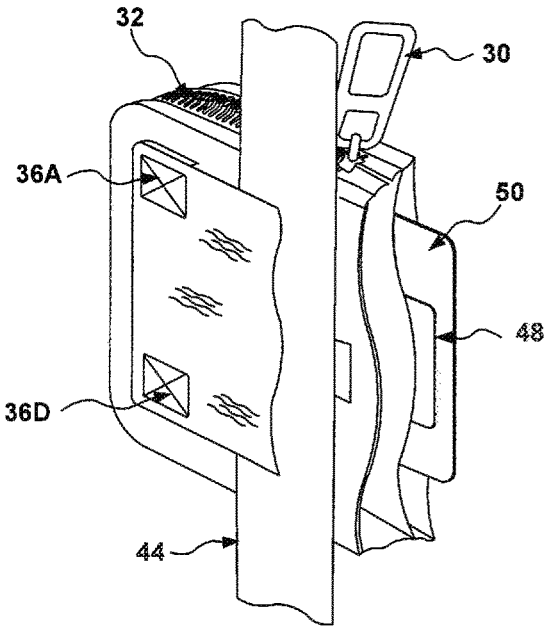
FIG. 12 is a rear perspective cutaway view of the present invention tool-bit holder pouch retained by a strap.
Figure 13:
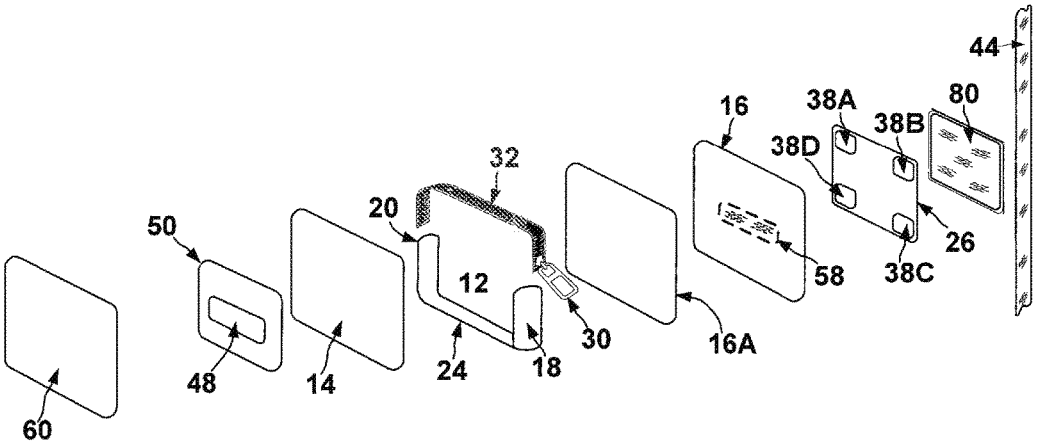
FIG. 13 is an exploded view showing the components of the present invention tool-bit holder pouch.

FIG. 11 is a side cross-sectional view of the present invention TBPH 10 restrained by a strap 44. FIG. 12 is a rear perspective cutaway view of the present invention TBPH 10 retained by a strap 44. FIG. 13 is an exploded view showing the components of the TBPH 10. Referring to FIGS. 11, 12, and 13, a front outer covering 60 is affixed to a front wall 14 with a chamber 62 between the front outer covering 60 and front wall 14. A magnet 48 is retained on a support member 50 such as a plastic card. The magnet 48 and support member 50 are retained in the closed chamber 62. As illustrated in the exploded view of FIG. 13, outer covering 60 is affixed to front wall 14 creating closed magnet chamber 62 retaining magnet 48 on support member 50. Interior pouch chamber 12 is within front wall 14, interior back wall 16A, left sidewall 20, top wall with zipper 32 thereon and right sidewall 18. Outer back wall 16 retains at least one strap retaining loop 34 facing hook and loop retaining member 26, with a gap S70 to enable strap 44 to be retained in strap retaining loop 34. The cutaway view in FIG. 12 illustrate the components from a rear perspective.

Figure 14:
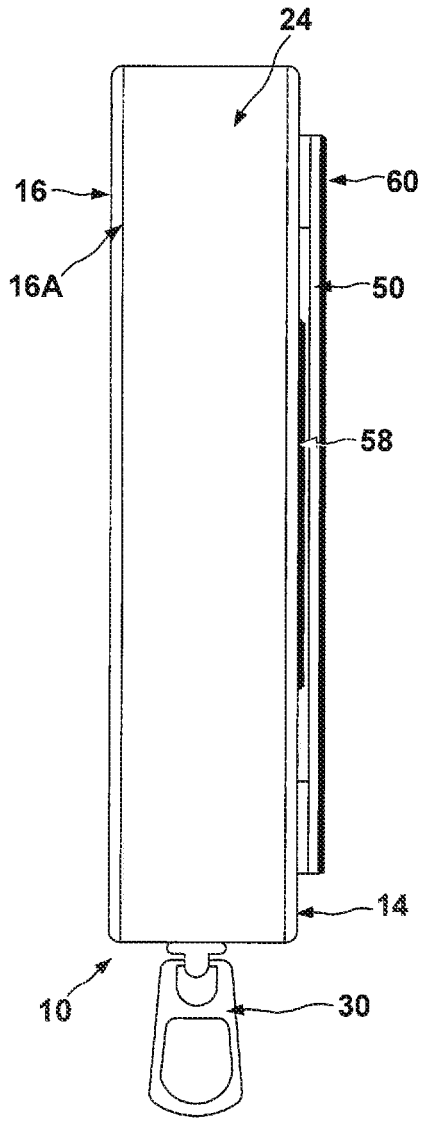
FIG. 14 is a bottom plan view of the present invention tool-bit holder pouch.

FIG. 14 is a bottom plan view of the present invention TBPH 10 illustrating some of the above described components.

Figure 5:
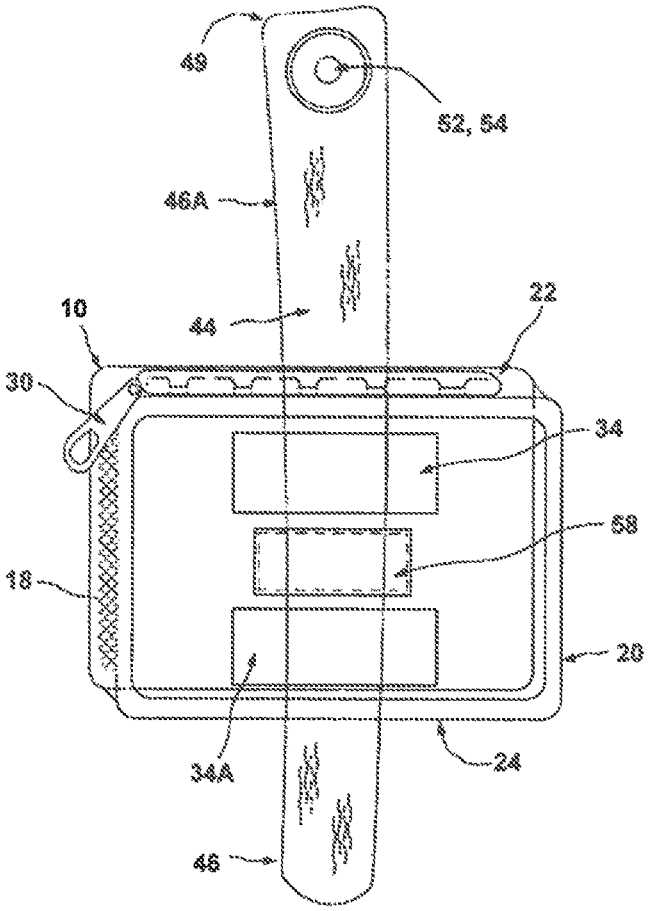
FIG. 5 is a rear perspective view of the present invention tool-bit holder pouch illustrating a strap inserted through the two strap retaining loops.
Figure 6:
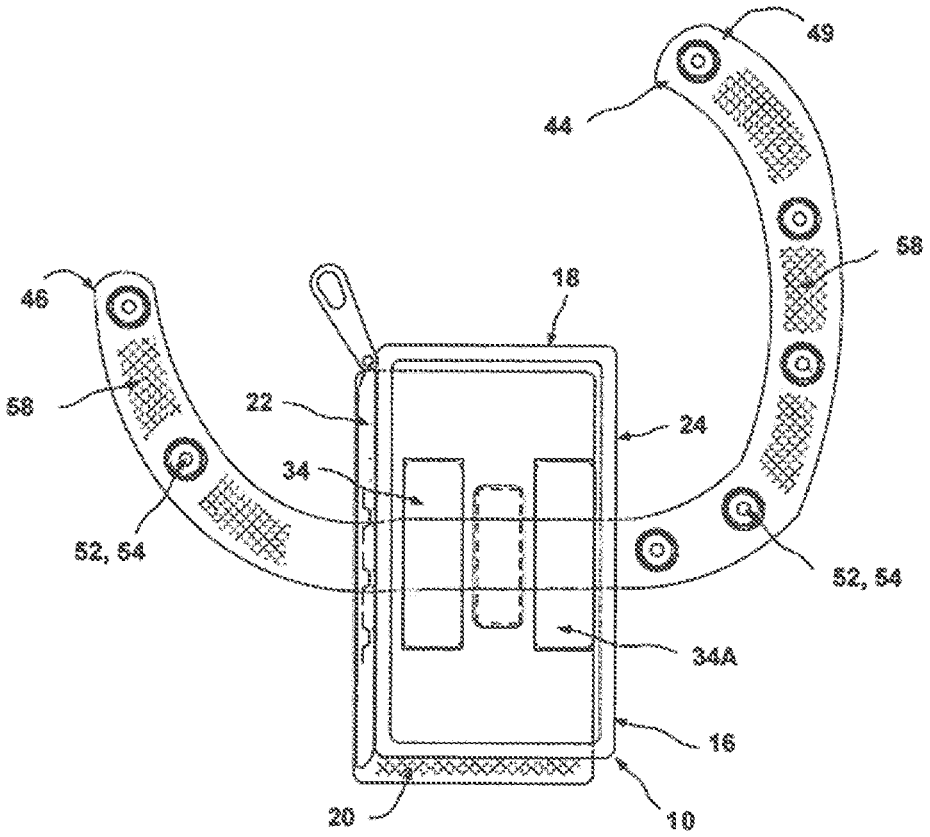
FIG. 6 is a rear perspective view of the present invention tool-bit holder pouch illustrating the strap with multiple male and female snap closures and hook and loop fasteners.

FIG. 5 is a rear perspective view of the present invention tool-bit holder pouch illustrating retaining strap 44 inserted through the two strap retaining loops 34 and 34A. FIG. 6 is a rear perspective view of the present invention tool-bit holder pouch illustrating the strap with multiple male and female snap closures and hook and loop fasteners. As shown in FIGS. 5 and 6, the strap 44 has a first end 46 and a second end 49. One end of the strap 44 is inserted through at least one, and preferably two, strap loops 34 and 34A located on the outer rear wall 16 of the TBPH 10 as shown in FIGS. 5 and 6. To facilitate securing the TBPH 10 to a tool, the strap utilizes either at least one male 52 and corresponding female closure 54. Alternatively, hook and loop fasteners 58 are on strap 44. It is within the spirit and scope of the invention to have multiple strap fasteners to allow the user to secure the TBPH 10 to various sizes of tools or battery packs. Additionally, to maintain the strap 44 in place, strips of hook and loop fasteners 58 can be placed on the inner surface of outride 16 of TBPH 10 as shown in FIG. 1. Between two strap loops 34 and 34A as illustrated in FIGS. 5 and 6, the hook and loop fasteners on the tool bit pouch TBPH-10 interface with a respective one of the hook and loop fasteners 58 on the strap 44, thereby maintaining the strap's position.

Figure 15:
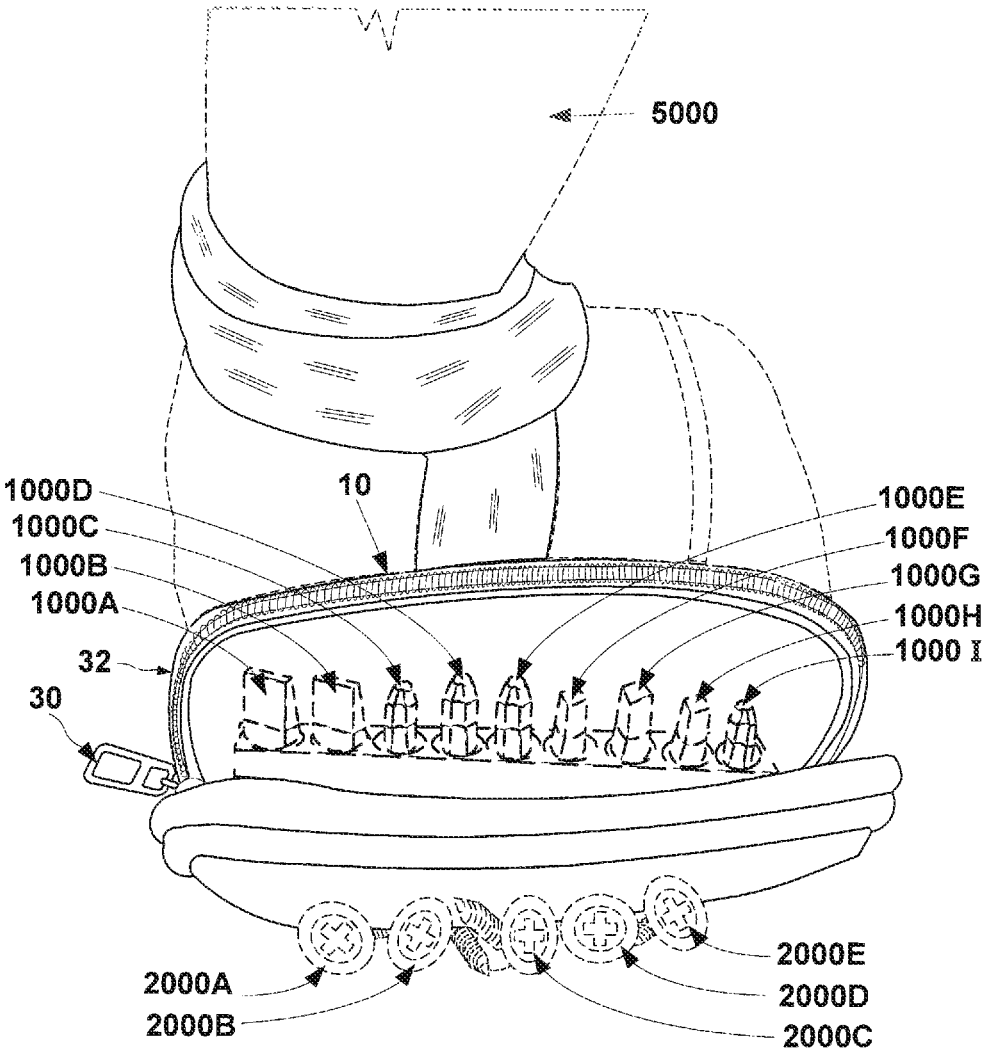
FIG. 15 is a top perspective view of the tool bit holder pouch in the opened condition retained around a tool by a strap.
Figure 16:
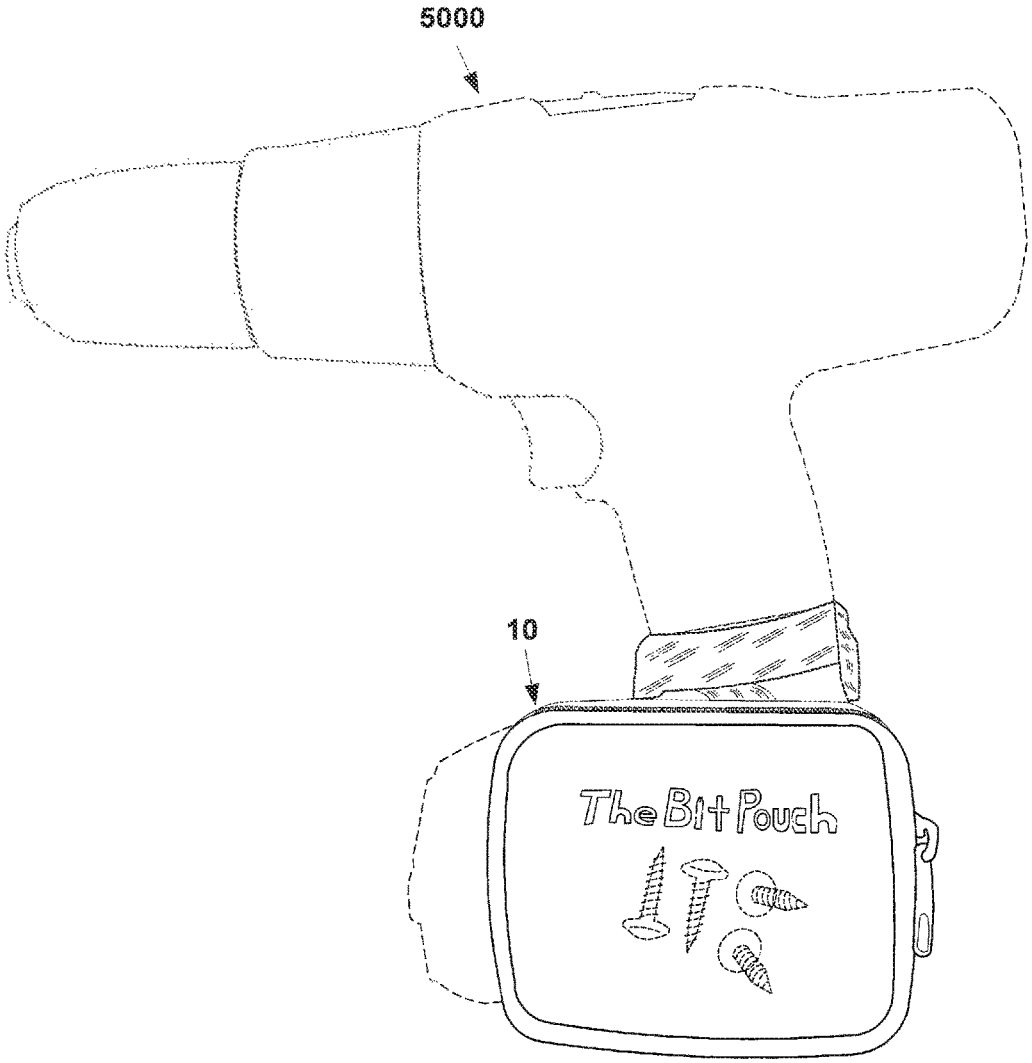
FIG. 16 is a side perspective view of the tool bit holder pouch in the opened condition retained around a tool by a strap.

FIG. 15 is a top perspective view of the TBPH 10 in the opened condition retained around a tool 5000 by retaining strap 44. FIG. 16 is a side perspective view of the TBPH 10 in the closed condition retained around a tool 5000 by retaining strap 44. The enclosed magnet 48 enables drill bits and other tool accessories 2000A, 2000B, 2000C, 2000D and 2000E to be retained against front covering 60 so that they can be easily grasped.

The strap 44 enables the TBPH 10 to be secured to a lower portion or battery pack of a power tool 5000 as illustrated in FIGS. 15 and 16. The TBPH 10 can be utilized with many different types of tools, both powered and non-powered, and is especially effective when secured to a power drill, which typically utilizes multiple, relatively small drill bits. Located on the upper edge 22 is a zipper closure 32 with a zipper handle 30, shown in several figures and best illustrated in FIGS. 7, 9, and 12 that provide access to the interior 12 of the TBPB-10. When closed, this enclosure allows for secure permanent storage of small drill bits or components, and the items are maintained safely and securely within the enclosure. The positioning of the magnet 48 and magnet support 50 allows various tool components or construction pieces 2000A, 2000B, 2000C, 2000D and 2000E such as drill bits, nuts, bolts, screws, etc. to be held onto and against outer cover 60 for ready access. The magnet 48 also enables tool components to be retained against the interior surface of front outer wall 14. With the TBPH 10 wrapped around a tool 5000 such as a drill, a worker can simply remove the drill bit or other construction tool with one hand while holding the tool in the worker's other hand, thereby making the construction process much easier.

Referring to FIGS. 15 and 16, the TBPH 10 has temporary storage for metal drill bits and small components containing metal by means of magnetism. Referring to FIG. 15, drill bits and small components are attracted to exterior covering 60. These drill bits and small components can then be removed and used with ease by the user of TBPH 10. The TBPH 10 is placed on the lower left or right side of a tool base or battery. The TBPH 10 is then secured by use of the strap 44. The TBPH 10 is then secured by use of strap 44. As illustrated in FIGS. 15 and 16, the strap 44 is affixed around the battery portion of a drill.

When the tool is being used, a person can quickly and easily access any of the tool components and/or construction pieces that are located within or on the TBPH 10. When not in use, the TBPH 10 can remain secured to a tool, or the TBPH 10 can be easily removed and stored separately. Tool bits 1000A, 1000B, 1000C, 1000D, 1000E, 100F, 1000G,

1000H and 1000I can be retained within pouch interior chamber 12 by magnet 48 or by a tool bit holder 40 as previously described. As previously disclosed, the TBPH 10 can be utilized with a variety of power or non-power, tools and can be easily switched from one tool to another. The TBPH 10 is designed to be durable and long-lasting. The TBPH 10 can be made of various materials such as nylon, leather or polyester. The TBPH 10 can be any color and can include indicia. It is within the spirit and scope of this invention to have the TBPH 10 sold as an after-market accessory for tools, or sold along with a tool as a competitive benefit or a promotional item.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A tool-bit pouch adapted for retention of and rapid access to a first multiplicity of metal tool bits used in conjunction with a hand tool, the tool bit pouch comprising:

a. a front outer covering having a front outer surface, the front outer covering affixed to a front wall creating a closed magnet chamber between the front outer covering and the front wall, a magnet retained on a support member, the magnet and support member retained within the closed magnet chamber;

b. a back including an outer back wall affixed to an interior back wall;

c. an interior pouch chamber bounded by the front wall, the interior back wall, a bottom wall, oppositely disposed halves of a top wall, a portion of a right sidewall and a portion of a left sidewall, a closing zipper extending from a location above the portion of the left sidewall to a location between said oppositely disposed halves of the top wall to a location above the portion of the right sidewall to close the interior pouch chamber, the closing zipper moved by a zipper handle;

d. a strap retaining loop affixed to the outer back wall, a hook fastener affixed to the outer back wall within the strap retaining loop;

e. a strap retaining member movably inserted through the strap retaining loop and removably retained by said hook fastener, said strap retaining member including a first end extending away from one side of the strap retaining loop and a second end extending away from a second side of the strap retaining loop, at least one first closing member on said first end of said strap retaining member and at least a second closing member on the second end of the strap retaining member; and f. the magnet and closed magnet chamber are separated from the strap retaining loop by at least the pouch inner chamber;

g. wherein said strap retaining member is wrapped around a portion of a hand tool and closed by said at least one first closing member being affixed to said at least second closing member with the front outer covering adjacent the hand tool for retention of and rapid access to said multiplicity of tool bits retained by the magnet against the front outer surface of the front outer covering.

2. A tool accessory pouch comprising:

a. a front outer covering having a front outer surface, the front outer covering affixed to a front wall creating a magnet chamber between the front outer covering and the front wall, a magnet retained on a support member, the magnet and support member retained within the magnet chamber;

b. a back wall, an interior pouch chamber having an opening closed by a closing member, a strap retaining loop affixed to the back wall and a fastener affixed to the back wall and within the strap retaining loop;

c. a strap retaining member movably inserted through the strap retaining loop and removably retained by said fastener within the strap retaining loop, said strap retaining member including a first end extending away from one side of the strap retaining loop and a second end extending away from a second side of the strap retaining loop, at least a first closing member on said first end of said strap and at least a second closing member on the second end of said strap; and d. the magnet and magnet chamber are separated from the strap retaining loop by at least the interior pouch chamber;

e. wherein said strap retaining member is wrapped around a portion of a hand tool and closed by said at least first closing member being affixed to said at least second closing member with the front outer cover adjacent the hand tool for retention of and rapid access to metal tool accessories retained by the magnet against the front outer surface of the front outer covering.

3. A tool accessory pouch comprising:

a. a front outer covering having a front outer surface, the front outer covering affixed to a front wall creating a magnet chamber between the front outer covering and the front wall, a magnet retained within the magnet chamber;

b. a back wall, an interior pouch chamber having an opening closed by a closing member, a strap retaining loop affixed to the back wall and a fastener affixed to the back wall and within the strap retaining loop; and c. a strap retaining member movably inserted through the strap retaining loop, the strap retaining member having a first end extending outside of the strap retaining loop and having a second end extending out of an opposite end of the strap retaining loop, each end of the strap retaining member having at least one closing member; and d. wherein said strap retaining member is wrapped around a portion of a hand tool and closed by said at least one closing member on the first and second end of the strap retaining member with the front outer cover adjacent the hand tool for retention of and rapid access to metal tool accessories retained by the magnet against the front outer surface of the front outer covering.

* * * * *